United States Patent [19]

Dolan

[11] 4,017,073

[45] Apr. 12, 1977

[54] HAND COMBAT WEAPON

[76] Inventor: Douglas B. Dolan, 620 Fairview Ave., Neptune, N.J. 07753

[22] Filed: Jan. 5, 1976

[21] Appl. No.: 646,662

[52] U.S. Cl. ..... 273/84

[51] Int. Cl.[2] ..... F41B 15/02

[58] Field of Search ..... 273/84 R; 272/74, 75, 272/85; 248/341

[56] References Cited

UNITED STATES PATENTS

| | | | |
|---|---|---|---|
| 3,588,021 | 6/1971 | Wormser | 272/85 X |
| 3,608,899 | 9/1971 | Hall | 273/84 R |

FOREIGN PATENTS OR APPLICATIONS

| | | | |
|---|---|---|---|
| 391,578 | 9/1908 | France | 272/75 |
| 5,567 | 4/1890 | United Kingdom | 272/75 |

OTHER PUBLICATIONS

"Black Belt"; Aug., 1974; p. 7.

*Primary Examiner*—Richard J. Apley
*Attorney, Agent, or Firm*—Charles F. Gunderson

[57] ABSTRACT

A device of the "nunchaku" type, for one of the phases of martial art style of combat, has at least two elongated members with adjacent ends connected by a chain or the like, so that one of the members can function as a handle and the other can serve as a club or cudgel. The coupling point at each of the adjacent ends of the elongated members has a swivel assembly that includes a pivot bolt with a head that holds the center portion of a U-shaped swivel that is free to rotate about the pivot bolt. A pin extends through the side arms of the U-shaped swivel and through the lower loop of a clevis or shackle, that is free to move from side to side above the head of the pivot bolt. One or more links of a chain connect the upper loops of the clevises or shackles of adjacent elongated members.

7 Claims, 4 Drawing Figures

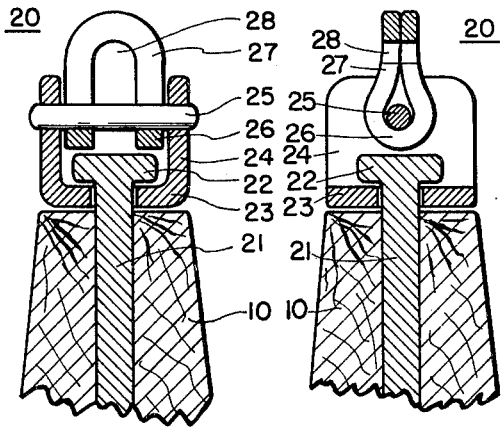
FIG. 2A FIG. 2B
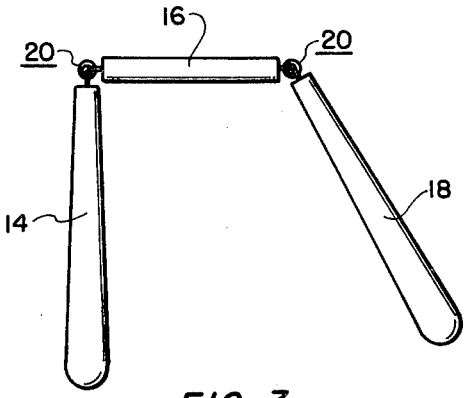
FIG. 3
FIG. 1
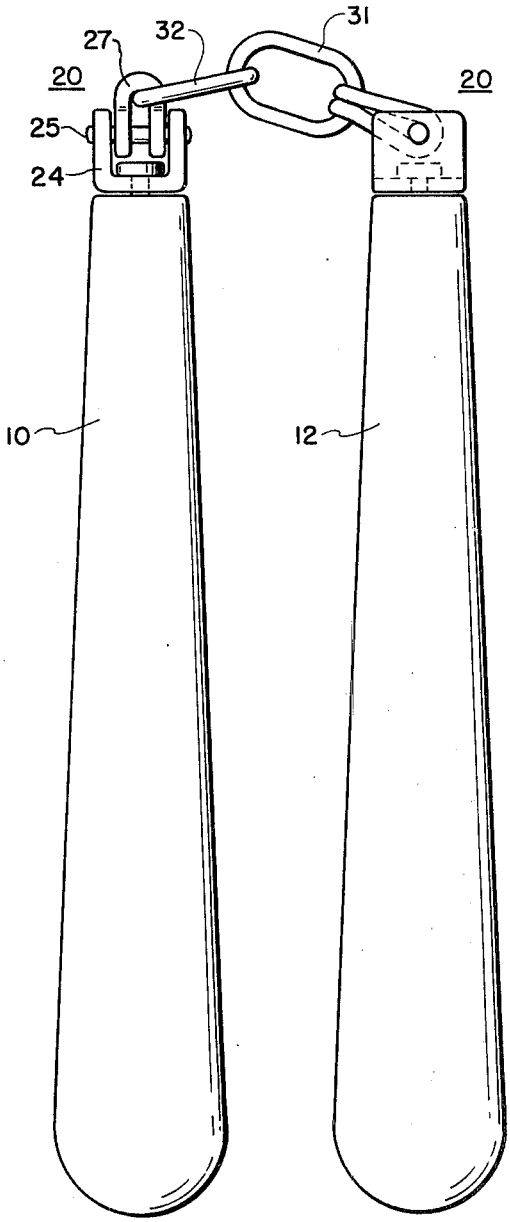

HAND COMBAT WEAPON

BACKGROUND OF THE INVENTION

Martial arts is a broad term for combative training methods including Judo, Karate, Kung-fu, etc. It also includes the use of various oriental and asian weapons; for example the Samurai sword, the quarter staff, etc. This type of martial-art combat is very old, although, since it is eastern — or oriental, rather than accidental — it is just becoming popular in western circles. One of the forms of combat involves a weapon that has two or more elongated, club-like members flexibly connected together in such a way that one member serves as a handle, and the other member — or members — serve as a club or cudgel and are free to be swung around the handle to engage a combatant.

For maximum dexterity, the flexible coupling between the two or more members must be as strong and as free-moving as possible so that the handle can swing the other members rapidly and smoothly through a circular arc without any binding or twisting of the coupling. For example, if a chain were used to connect the extremities of two members, the chain links would permit the club member to swing about the handle member, but the chain links would, inevitably, bind or toggle on one another in the course of the rotation.

To accommodate this, conventional swivels have been adapted to one or both ends of the adjacent members to permit more smooth rotation than is possible with the simple chain connection that is rigidly attached at each end. However these swivels usually consist of a form of eye or loop ending in a pin that extends into a hole within which it swivels. This type of swivel is very common and is used on everything from dog leashes to anchor cables, but this type of swivel creates a problem in the distance of the eye or loop above the actual pivot.

This is not important in the case of dog leashes or anchor cables, where the twisting and turning action is almost always along the direction of the rope or cable. However, in the case of a "nunchaku", the strongest pull is at right angles to the joint, and is increased by the centrifugal force of the weapon member being swung around the handle. This lateral pull has a large amount of friction that weakens and wears the swivel joint, giving it a relatively shorter life, a greater possibility of failure, and more chance of binding in use.

In addition, the retaining cap on the handle, for example, covers the head of the swivel shank, so there is no way to see the inevitable wear on the head of the swivel shank and have any warning as to when it is worn to a dangerous degree. This type of swivel is also different to disassemble or replace.

SUMMARY OF THE INVENTION

A "nunchaku" type weapon has at least two elongated members with one functioning as a handle. These members are joined together, in series, by chain links and swivel assemblies that include a pivot bolt or pin extending into the end of each adjacent member. This pivot bolt extends through a hole in the center portion of a flat U-shaped swivel, and a head on the pivot bolt holds the U-shaped swivel adjacent to the end of the corresponding member. A clevis pin through the opposing sides of the U-shaped swivel extends through the loop in the lower portion of a clevis or shackle and holds it, moveably, in close proximity to the head of the pivot bolt. The upper loop of the clevis of one member may be connected by one or more links of chain to the upper loop of the clevis of the swivel assembly of the adjacent member.

The combination of elements provides a swiveling coupling for "nunchaku" members that is unusually strong and durable against lateral stress during continuous rotary motion. The leverage against the pivot bolt is reduced to a minimum by the minimal distance between the center of the U-shaped swivel and the clevis pin. The swiveling elements are clearly visible for observation for any significant wear, although this will be minimal because of the unique configuration and the face that it permits the use of heavier pivoting elements.

BRIEF DESCRIPTION OF THE DRAWINGS

FIG. 1 shows a basic "nunchaku" with two members;

FIGS. 2A and 2B show cross sections of the swivel assembly; and

FIG. 3 shows a "nunchaku" with three members.

DESCRIPTION OF THE PREFERRED EMBODIMENT

Referring now to FIG. 1, a typical "nunchaku" having the minimum 2 members is shown with the elongated members 10 and 12 side by side and connected by links of chains 31 and 32 to swivel assemblies 20 in the ends of adjacent members 10 and 12.

FIG. 2A shows a cross section of one of the swivel assemblies in one direction and FIG. 2B shows a cross section of the swivel assembly in an orthogonal direction. In both figures 2A and 2B a portion of the end of the elongated member 10 is seen with a pivot bolt 21 seated within the elongated member. The pivot bolt must have a head 22 to secure a center portion 23 of a U-shaped swivel whose side portions 24 hold a pin 25 that extends through the lower portion or loop 26 of a moveable clevis or shackle. An upper portion 27 of the clevis has a loop 28 that can receive the link of a chain such as 31 or 32 as seen in FIG. 1.

FIG. 3 shows another variation of "nunchaku" which has three members 14, 16 and 18 connected by swivel assemblies 20 of the type shown here. FIG. 3 also illustrates one of many multiple element variations wherein the members are of varying lengths.

It is seen, particularly in FIGS. 2A and 2B that this design permits the use of a sturdy pivot bolt 21 with a solid head 22 that will secure the U-shaped swivel, free to rotate, unimpeded, in any direction. This design keeps the clevis pin 25, that provides a moveable coupling for the lower portion of the clevis or shackle 26, very close to the head 22 of the pivot bolt. This reduces the leverage of the U-shaped swivel against the head of the pivot bolt to a minimum when the full weight and centrifugal force of the club is pulling sideways, against the end of the handle in a normal function of the weapon.

The upper loops of the clevis may hold the links of chain as seen in FIG. 1. The number of links would depend on the design and function of the device. In a typical embodiment of the "nunchaku" of the so-called "Bruce Lee" style the spacing between adjacent swivels would be about 4 to 9 inches, and the elongated members would be between 12 and 16 inches.

The basic "nunchaku" weapon, as seen in FIG. 1, has 2 members; one serves as the handle and other serves as the free-swinging club or cudgel, and the two members are usually of the same length. However, three or more elongated members may be used, as illustrated in FIG. 3. Here again, swivel assemblies are provided on each end of the adjacent members, and chain links may be provided for any desired separation between the members. A variation in the lengths of the members is shown here since there can be a considerable variation in the lengths, thickness, and shapes, as well as weights of the various members. These variations will produce corresponding variations in the effects of the free-swinging members as they are controlled by the member being used as a handle.

When three or more members are connected in series, the members will usually be relatively shorter, since the overall length of the device must have practical limits for effective control and use. A two-member unit, on the other hand will have longer members for effective reach.

The members will usually have a slight taper to provide a more secure grip and reduce the possibility of the handle slipping out of the users hand. The members may be round and smooth, or may be fluted or ornamented in any desired way for better grip or ease of identification.

Wood is the obvious material for the elongated members but, obviously, other materials of similar density — such as plastics — may be used. Two or more materials may be combined for special effects, such as variations in center of gravity or surface hardness.

The pivot bolt may be embedded in the elongated member in any desired manner. Basically it would be threaded and screwed into the member until the lower surface of the head 22 is close enough to the upper surface of the center portion to hold it in its operating position while permitting unrestricted rotation of the swivel. The pivot bolt will normally be made of a suitable metal for maximum strength and minimum wear.

The U-shaped swivel can be formed of a flat piece of metal with the sides bent up. The swivel may also be cast and machined in a well known manner.

Washers of metal or plastic, of well-known types can be used between the swivel and the end of the corresponding member, or between the swivel and the head of the pivot bolt. Thrust bearings of suitable types may also be used to reduce friction and provide quieter, smoother operation.

The clevis may also be formed of a flat piece of metal with an elongated central slot. When this is wrapped around the clevis pin it forms a wide bearing of relatively thin metal. This permits the placement of the clevis pin quite close to the head of the pivot bolt to reduce the mechanical advantage of the lateral pull against the swivel assembly, as noted earlier, to greatly increase the strength and improve the functioning of the swivel.

The effectiveness of this device, and the predictable life are great enough that the elements may be permanently secured in manufacture. However, it will be obvious that the clevis pin may be of a removeable type, and the pivot bolt may also be removeable to permit the interchange or replacement of any individual element. This would be a particular advantage where different lengths of chain or different sizes or shapes of elongated members may be desired, since they can be interchanged at will.

It is to be understood that I do not desire to be limited to the exact details of construction shown and described, for obvious modifications will occur to a person skilled in the art.

What is claimed is:

1. In combination with a "nunchaku" type weapon having at least two elongated members, means for coupling the adjacent ends of said elongated members together comprising swivel assemblies connecting each of the pairs of said adjacent ends; each of said swivel assemblies comprising a first elongated pivot bolt extending centrally within a first end of each of said pairs of adjacent ends; a second elongated pivot bolt extending centrally within a second end of each of said pairs of adjacent ends; each of said elongated pivot bolts having a rigid, enlarged, head portion; a first U-shaped swivel having a flat center portion, said center portion having a centrally-located hole, fitting loosely about said first pivot bolt beneath its enlarged head portion; a second U-shaped swivel having a flat center portion, said center portion having a centrally-located hole fitting loosely about said second pivot bolt beneath its enlarged head portion; a first clevis pin extending between the opposing sides of said first U-shaped swivel; a first clevis having a lower and an upper portion, said lower portion of said first clevis forming a first loop about said first clevis pin, said upper portion of said first clevis forming a second loop; a second clevis pin extending between the opposing sides of said second U-shaped swivel; a second clevis having a lower portion and an upper portion, said lower portion of said second clevis forming a first loop about said second clevis pin, said upper portion of said second clevis forming a second loop; and means for connecting said second loops of said first and second clevises of each of said pairs of adjacent ends to provide a freely-swivelling coupling between said members.

2. A device as in claim 1 wherein at least one of said members is rounded and tapered to function as a handle.

3. A device as in claim 1 wherein said elongated members are of equal lengths.

4. A device as in claim 1 having at least three elongated members of unequal lengths.

5. A device as in claim 1 wherein said means for coupling said second loops of said first and second clevises comprises at least one link of chain.

6. A device as in claim 1 wherein said means for coupling said second loops of said first and second clevises comprises a plurality of chain links.

7. A device as in claim 1 wherein each of said pivot bolts is driven into a tight hole extending centrally within a corresponding one of said ends of said elongated members.

* * * * *